US005124898A

United States Patent [19]

Chabria

[11] Patent Number: 5,124,898

[45] Date of Patent: Jun. 23, 1992

[54] POCKET FLASHLIGHT WITH WHISTLE

[75] Inventor: Paul R. Chabria, Wayne, Ill.

[73] Assignee: Press-A-Lite Corporation, West Chicago, Ill.

[21] Appl. No.: 625,862

[22] Filed: Dec. 11, 1990

[51] Int. Cl.[5] ..... F21V 33/00

[52] U.S. Cl. ..... 362/253; 362/109; 362/189; 362/205; 116/3

[58] Field of Search ..... 362/96, 109, 86, 157, 362/253, 189, 205; D26/38; 446/204; 116/3, 137 R, DIG. 7

[56] References Cited

U.S. PATENT DOCUMENTS

D. 155,059 8/1949 Weston ..... D26/38

D. 184,293 1/1959 Schwartz ..... D26/38

1,930,504 10/1933 Benjafield ..... 362/86

2,893,344 7/1959 Meyers ..... D26/38

4,314,316 2/1982 Gertler et al. ..... 362/86

4,449,474 5/1984 Mariol ..... 362/96

4,628,418 12/1986 Chabria ..... 362/189

*Primary Examiner*—Stephen F. Husar

*Attorney, Agent, or Firm*—Lee, Mann, Smith, McWilliams Sweeney & Ohlson

[57] ABSTRACT

A manually blowable whistle is structurally and functionally combined with a pocket flashlight. The whistle may be sounded independently of activation of the flashlight and the flashlight may be used without sounding the whistle.

4 Claims, 2 Drawing Sheets

POCKET FLASHLIGHT WITH WHISTLE

BACKGROUND AND SUMMARY OF THE INVENTION

Small flashlights suitable for carrying in a garment pocket or in a woman's purse are available in a variety of forms and arrangement of functional parts. A very convenient and useful flashlight of this category is illustrated and described in Paul R. Chabria U.S. Pat. No. 4,419,718. It comprises an assembly of batteries mounted in a holder, a lamp, and necessary electrical connections, all contained within a casing having flexible walls by means of which an internal switch may be operated to close or leave open the electrical circuit. The circuit is normally open, of course, while the flashlight is kept in a pocket or in a purse but may be very easily activated by pressing opposite sides of the casing toward each other whereby one side is brought to bear against a spring switch arm to close the electrical circuit.

A very common use of the pocket flashlight is to locate a keyhole in a door when darkness renders it difficult to find without the light. As shown in Paul R. Chabria U.S. Pat. No. 4,628,418, a keychain for holding a door key may be attached to the flashlight. This patent also describes the inclusion of a magnet for holding the flashlight to a metal surface and also a watch. One or more of these accessories may be provided as a part of the flashlight.

To further augment the services of the flashlight unit, audio alarm or signal means have also been incorporated into flashlights. Examples of such combinations are to be found in Meyers U.S. Pat. No. 2,893,344, Gertler U.S. Pat. No. 4,314,316 and Hsieh U.S. Pat. No. 4,703,402. The flashlight of Meyers incorporates a horn which is operated by the old-fashioned rubber air bulb. When the bulb is squeezed, the horn is sounded, the air passing through the body of the flashlight. The flashlight of the Hsieh patent includes an audio alarm which is operated by the flashlight batteries and is separately activated by one of several buttons on the flashlight body. The Gertler patent shows a flashlight that is turned on by air blown into a mouthpiece. When the air is no longer blown into the device, the light turns off. A whistle is built into the unit to be sounded by the same air stream that controls the lighting circuit.

The invention described herein is a pocket flashlight of the type shown in the Paul R. Chabria patents above-identified. An audio alarm or signal service is provided as a part of the flashlight unit by incorporating a manually blowable whistle in the base of the unit which serves as the outer closure of the bottom of the flashlight, a sound cavity being formed by the inner and outer bottom closures of the flashlight. While structurally combined into a single unit, the lighting function and the whistle function are operated independently of each other.

BRIEF DESCRIPTION OF THE DRAWING

In the accompanying drawing.

DESCRIPTION OF MODES BEST EMBODYING THE INVENTION

Figure 1:
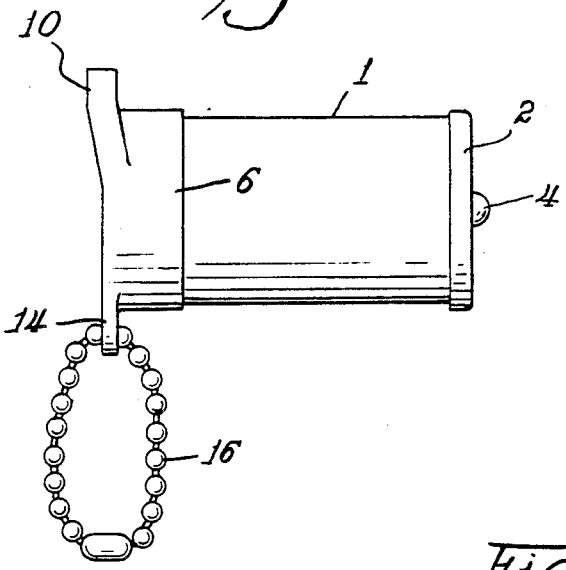
FIGS. 1 and 2 are side-elevational views of the combined pocket flashlight and whistle of the invention, FIG. 2 showing a convenient upside down posture of the unit when held in the hand of a person blowing the whistle.
Figure 2:
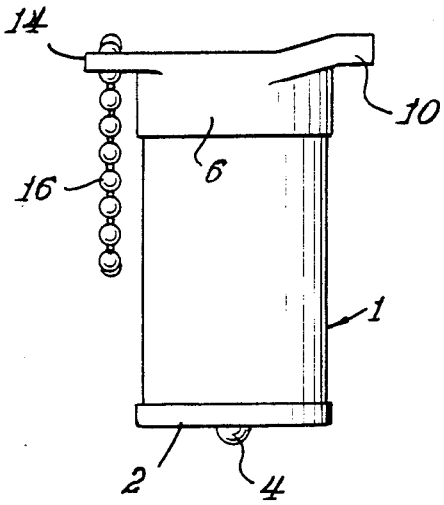
Figure 3:
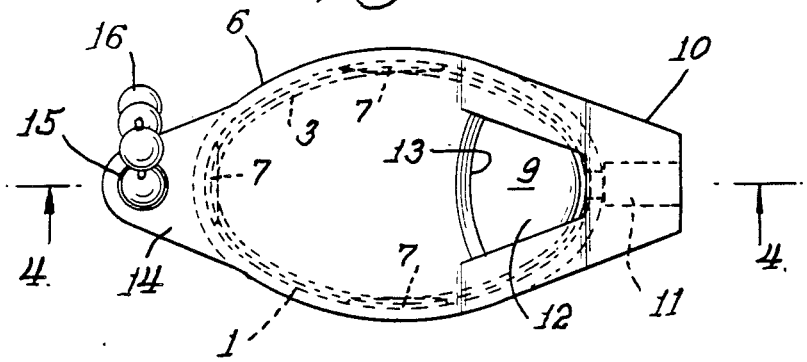
FIG. 3 is a bottom view of the flashlight/whistle unit.
Figure 4:
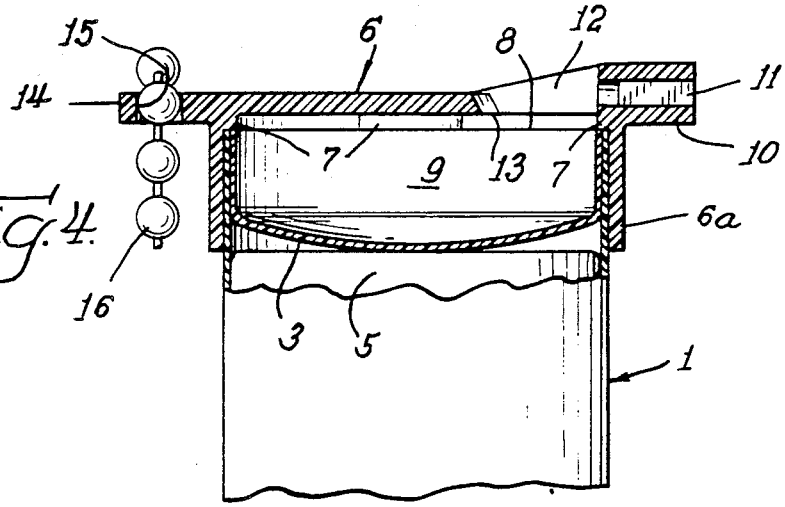
FIG. 4 is a cross-sectional view taken at the line 4—4 of FIG. 3.
Figure 5:
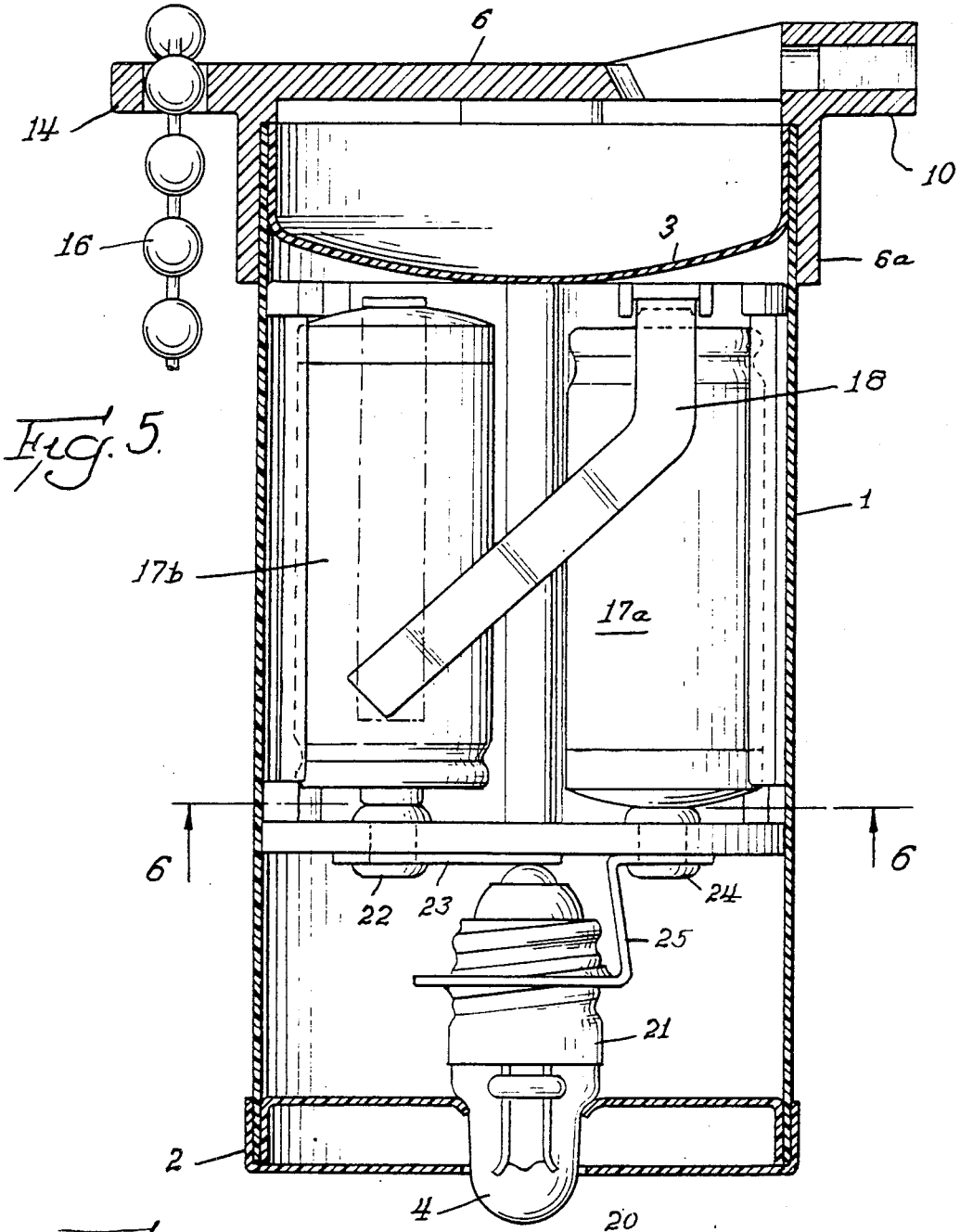
FIG. 5 is a cross-sectional view of the flashlight-whistle showing the internal parts of the flashlight which provide the light circuit switching means of the flashlight.
Figure 6:
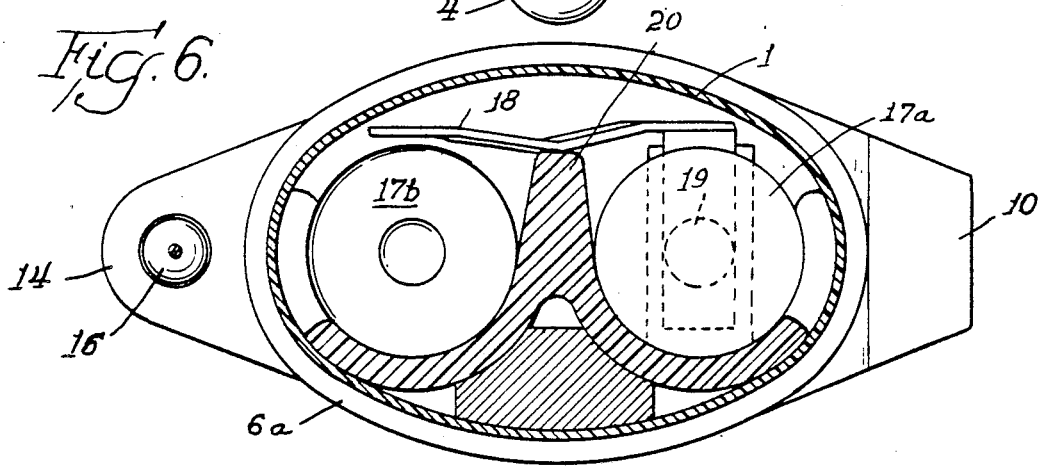
FIG. 6 is cross-sectional view taken at the line 6—6 of FIG. 5.

In the combined flashlight/whistle unit of the invention, substantially the entire operating assembly of the flashlight and the resonating cavity of the whistle are enclosed within a casing 1 which is closed at its top by a cap 2 and at its bottom by an insert tray 3. Top cap 2 does have an opening at its center through which the top of the flashlight lamp 4 protrudes. As is seen in FIG. 4 the inner closure insert tray 3 engages the bottom of battery holder 5. Examples of battery assemblies, including battery holder 5, suitable for use in the combined unit herein described are shown and described in detail in the above referred to U.S. Pat. Nos. 4,419,718 and 4,628,418, to which reference is made as a part of the specification herein. As is specified in these prior patents, casing 1 is composed of thin, flexible plastic material to permit the closing of a switch to activate the flashlight. A pair of dry cell batteries **17*a* and 17*b* are mounted within the casing and a flexible metal switch arm 18 is secured at one end to positive terminal 19 of battery 17*a* and extends across non-conductive supporting structure 20 to a position lying over but normally spaced from unjacketed battery 17*b*. As is seen best in FIG. 6, pressure applied to the end portion of arm 18 through flexible casing 1 can provide contact of the switch arm to the negative terminal of battery 17*b* to close the flashlight circuit. The circuit including light bulb 21 is completed by conductive members 22, 23, 24 and 25**. Upon release of the activating pressure, both the casing and switch arm return to their normal positions at which engagement of the switch arm to the negative terminal of the battery is terminated and the lighting circuit is opened.

Base 6 completes the; unit. This outer closure, which may advantageously be a plastic castings, has an annular skirt flange **6*a* the inner diameter of which conforms in size and contour with the outside of casing 1 whereby it can be slid onto and snugly fit over the bottom portion of the casing to which it may be cemented. The base may be provided with shoulder bosses 7 to serve as stops to positively establish the location of the base with respect to the casing 1. Rim 8 of insert tray 3 may also be at approximately the level of bosses 7 and the bottom edge of casing 1. Inner closure tray 3 together with outer closure base 6 thus define a whistle cavity 9**.

A whistle mouthpiece 10 is molded integrally with base 6. The mouthpiece is wider than it is deep to generally fit into the mouth of the whistle blower. The mouthpiece has a passageway 11 molded therein to direct a stream of air across whistle opening 12 toward whistle edge 13. This whistle assembly, molded as an integral part of base 6, together with flashlight inner closure insert tray 3 complete the functioning structure of the whistle.

If desired, and as shown, a bracket ear 14 may also be molded integrally with base 7. An opening 15 is provided through with the key chain 16 passes.

ACHIEVEMENT

The combined flashlight/whistle unit provides a whistle as a part of the flashlight structure in a compact arrangement in which the whistle employs parts of the bottom of the flashlight, especially the insert tray 3 and base 6, to form the whistle. The unit can be carried in a pocket or a woman's purse for ready access in case of need. The flashlight and the whistle are activated independently of each other although they may be operated concurrently.

I claim:

1. A combined pocket flashlight and whistle comprising a generally cylindrical casing having flexible side walls and containing the flashlight assembly, said assembly including light circuit switching means responsive to the flexing of said side walls, said casing having an insert tray therein forming the inner closure of the bottom end of said casing, said inner closure being spaced inwardly from the bottom end of said casing, a base seated upon said casing at the bottom end thereof forming another closure and defining with said inner closure a whistle cavity, said base having integrally therein whistle structure including a whistle mouthpiece and whistle opening; said whistle structure together with said whistle cavity forming a manually blowable whistle.

2. A combined pocket flashlight and whistle in accordance with claim 1 wherein said base is a plastic casting.

3. A combined pocket flashlight and whistle in accordance with claim 2 wherein said whistle mouthpiece extends laterally from said base and is arranged to direct a stream of air blown into said mouthpiece across said whistle opening and toward the remote edge of said opening.

4. A combined pocket flashlight and whistle in accordance with claim 3 wherein said remote edge of said whistle is sharp.

* * * * *